US007690478B2

(12) United States Patent
Kostun et al.

(10) Patent No.: US 7,690,478 B2
(45) Date of Patent: Apr. 6, 2010

(54) CONTINUOUSLY VARIABLE TUNED RESONATOR

(75) Inventors: John David Kostun, Brighton, MI (US); David John Moenssen, Canton, MI (US); Mark Donald Hellie, Westland, MI (US); Erich James Vorenkamp, Pinckney, MI (US); Christopher Edward Shaw, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 285 days.

(21) Appl. No.: 11/521,934

(22) Filed: Sep. 15, 2006

(65) Prior Publication Data

US 2008/0066999 A1 Mar. 20, 2008

(51) Int. Cl.
*F01N 1/02* (2006.01)
*F01N 7/00* (2006.01)
*F02M 35/10* (2006.01)

(52) U.S. Cl. ..... 181/250; 181/241; 123/184.57

(58) Field of Classification Search ..... 181/250, 181/266, 273, 276, 237, 254, 241, 271, 277, 181/278; 123/184.57, 184.56, 184.55, 184.53
See application file for complete search history.

(56) References Cited

U.S. PATENT DOCUMENTS 1,910,672 A * 5/1933 Bourne ..... 181/276
2,297,046 A * 9/1942 Bourne ..... 181/250
4,006,793 A * 2/1977 Robinson ..... 184/53
4,300,488 A 11/1981 Cser
4,539,947 A 9/1985 Sawada et al.
4,546,733 A 10/1985 Fukami et al.
4,788,942 A 12/1988 Pouring et al.
4,874,062 A * 10/1989 Yanagida et al. ..... 181/250
4,892,168 A * 1/1990 Sasaki et al. ..... 181/250
4,974,568 A 12/1990 Cser
5,040,495 A * 8/1991 Harada et al. ..... 123/184.57
5,189,266 A * 2/1993 Sasaki et al. ..... 181/227
5,283,398 A * 2/1994 Kotera et al. ..... 181/224
5,317,112 A * 5/1994 Lee ..... 181/250
5,333,576 A 8/1994 Verkleeren
5,349,141 A * 9/1994 Horibe et al. ..... 181/224
5,377,629 A * 1/1995 Brackett et al. ..... 123/184.56
5,493,080 A * 2/1996 Moss ..... 181/232
5,572,966 A 11/1996 Doddy et al.
5,575,249 A 11/1996 Mielke et al.
5,595,150 A 1/1997 Horlacher
5,628,287 A 5/1997 Brackett et al.
5,723,828 A * 3/1998 Nakagawa ..... 181/250
5,771,851 A 6/1998 McLean
5,783,780 A * 7/1998 Watanabe et al. ..... 181/229
5,839,405 A 11/1998 Falkowski et al.
5,894,823 A 4/1999 Lee (Continued)

FOREIGN PATENT DOCUMENTS

JP 60017226 A * 1/1985

(Continued)

*Primary Examiner*—Edgardo San Martin
(74) *Attorney, Agent, or Firm*—Fraser Clemens Martin & Miller LLC; J. Douglas Miller

(57) ABSTRACT

A resonator for a vehicle air intake system is disclosed, wherein the resonator is variable tuned to militate against the emission of sound waves caused by the engine and other sources at a wide range of engine speeds.

20 Claims, 8 Drawing Sheets

U.S. PATENT DOCUMENTS 5,937,815 A 8/1999 Hidaka
6,006,712 A 12/1999 Suzuki
6,009,705 A * 1/2000 Arnott et al. ..... 60/312
6,155,224 A 12/2000 Akihisa et al.
6,213,077 B1 4/2001 Horii
6,347,609 B1 2/2002 Bloomer
6,422,192 B1 7/2002 Bloomer
6,450,141 B1 9/2002 Sakuma
6,494,290 B1 12/2002 Jessberger
6,508,331 B1 1/2003 Stuart
6,530,984 B2 3/2003 Stuart
6,600,408 B1 7/2003 Walter et al.
6,609,489 B1 * 8/2003 Slopsema et al. ..... 123/184.57
6,684,842 B1 2/2004 Hellie et al.
6,698,390 B1 3/2004 Kostun et al.
6,732,509 B2 5/2004 Shiga
6,732,510 B2 * 5/2004 Ciray ..... 60/312
6,758,304 B1 7/2004 McLean
6,783,579 B2 8/2004 Pettipiece
6,792,907 B1 9/2004 Kostun et al.
6,805,087 B2 10/2004 Yakabe et al.
6,814,041 B1 11/2004 Cheng et al.
6,848,410 B2 2/2005 Hoffmann et al.
6,938,601 B2 9/2005 Fukumoto
6,959,679 B2 11/2005 Concialdi
7,055,484 B2 * 6/2006 Marks et al. ..... 123/184.57
7,089,901 B2 * 8/2006 Kino et al. ..... 123/184.57
7,255,197 B2 * 8/2007 Horiko ..... 181/250
2005/0199439 A1 9/2005 Goenka et al.
2005/0205041 A1 9/2005 Moenssen et al.
2005/0205354 A1 9/2005 Goenka et al.
2006/0027204 A1 * 2/2006 Vogt et al. ..... 123/184.57
2006/0086564 A1 4/2006 Kostun et al.

FOREIGN PATENT DOCUMENTS

JP 60022021 A * 2/1985
JP 02091419 A * 3/1990
JP 03107522 A * 5/1991

* cited by examiner

FIG - 1
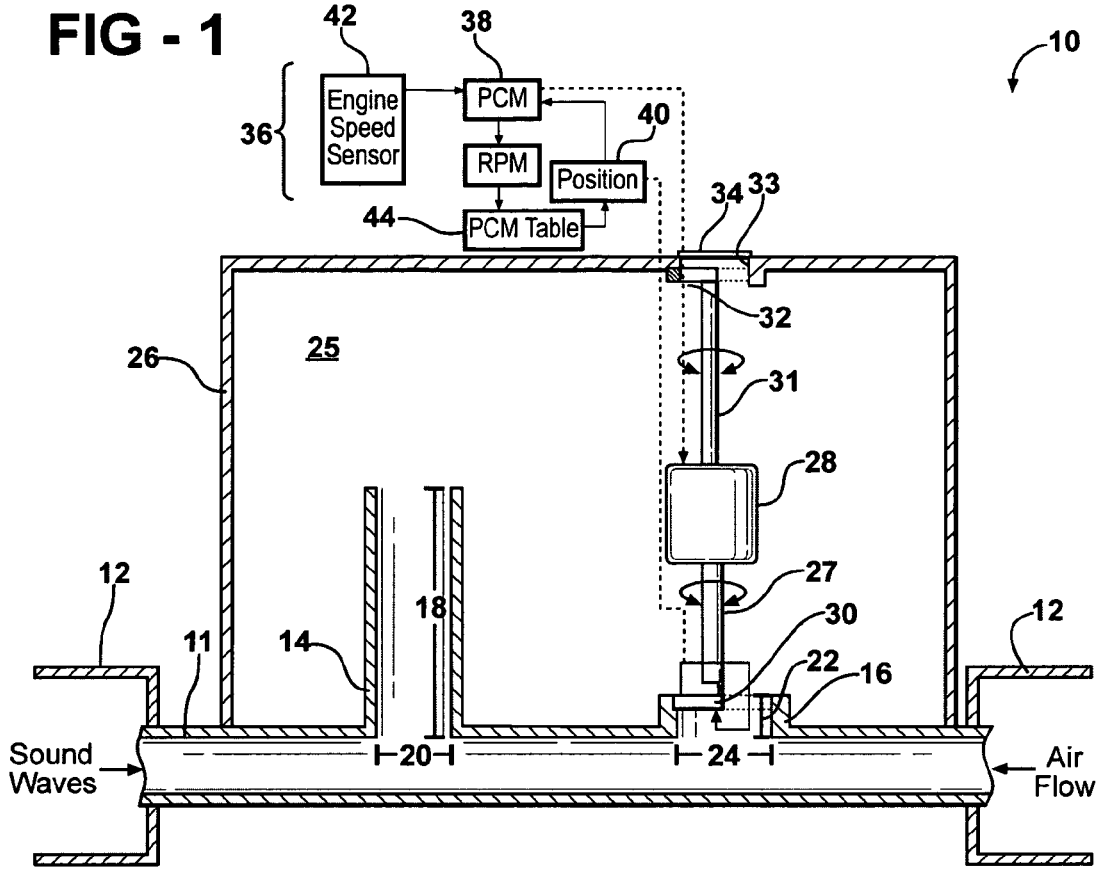
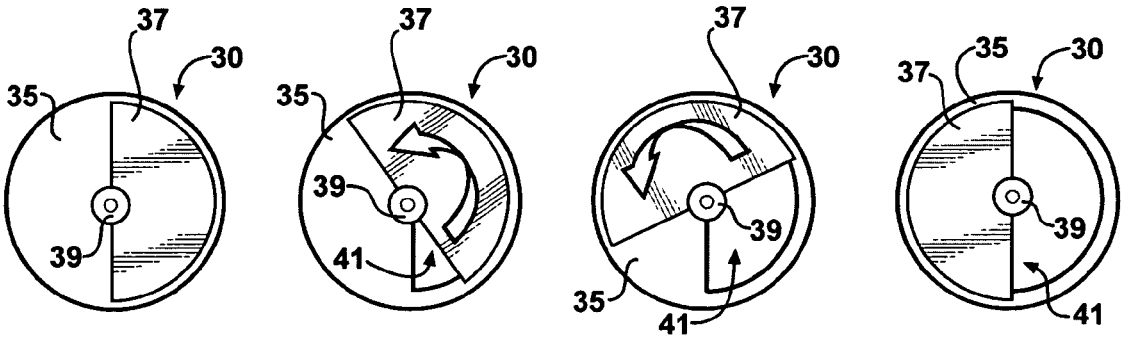
FIG - 2A FIG - 2B FIG - 2C FIG - 2D

CONTINUOUSLY VARIABLE TUNED RESONATOR

FIELD OF THE INVENTION

The present invention relates to a resonator and more particularly to a continuously variable tuned resonator for control of engine induction noise in a vehicle.

BACKGROUND OF THE INVENTION

In an internal combustion engine for a vehicle, it is desirable to design an air induction system in which sound energy generation is minimized. Sound energy is generated as air is drawn into the engine. Vibration is caused by the intake air in the air feed line which creates undesirable intake noise. Resonators of various types such as a Helmholtz type, for example, have been employed to reduce engine intake noise by reflecting sound waves generated by the engine 180 degrees out of phase. The combination of the sound waves generated by the engine with the out of phase sound waves results in a reduction or cancellation of the amplitude of the sound waves. Such resonators typically include a single, fixed volume chamber for dissipating the intake noise. Multiple resonators are frequently required to attenuate several sound waves of different frequencies.

Desired noise level targets have been developed for a vehicle engine induction system. The noise level targets often cannot be met with a conventional multi-resonator system. The typical reason is that conventional resonator systems provide an attenuation profile that does not match the profile of the noise targets and yields unwanted accompanying side band amplification. This is particularly true for a wide band noise peak. The result is that when a peak value is reduced to the noise level target line at a given engine speed, the amplitudes of adjacent speeds are higher than the target line. Thus, the resonators are effective at attenuating noise at certain engine speeds, but ineffective at attenuating the noise at other engine speeds.

Existing controlled variable tuned resonators vary resonator volume to achieve the desired noise reduction as a function of engine speed. Volume control of the resonators requires the movement of large sealed areas, which presents several problems, including increased motor load and undesirable wear on the seal.

It would be desirable to produce a resonator that does not require sealing of the resonator volume and is variable tuned to militate against the emission of sound energy caused by the vehicle engine induction process at a wide range of engine speeds.

SUMMARY OF THE INVENTION

Harmonious with the present invention, a resonator that does not require sealing of the resonator volume and is variable tuned to militate against the emission of sound energy caused by the vehicle engine and other sources at a wide range of engine speeds, has surprisingly been discovered.

In one embodiment, a variable tuned resonator comprises a first connector adapted to provide fluid communication between a duct and a first chamber; and a second connector adapted to provide fluid communication between the duct and the first chamber, the second connector having a neck diameter and an adjustable cover portion movable between an open position, a plurality of intermediate positions, and a closed position to change an inlet area of the neck diameter to facilitate attenuation of a desired frequency of sound wave entering the resonator.

In another embodiment, a variable tuned resonator comprises a first housing forming a first chamber therein; a first connector adapted to provide fluid communication between a duct and the first chamber; a second connector adapted to provide fluid communication between the duct and the first chamber, the second connector having a neck diameter and an adjustable cover portion movable between an open position, a plurality of intermediate positions, and a closed position to change an inlet area of the neck diameter to facilitate attenuation of a desired frequency of sound wave entering the resonator; and a resonator control system comprising: a programmable control module in communication with the cover portion, wherein the programmable control module controls the movement of the cover portion responsive to an engine speed.

In another embodiment, a variable tuned resonator comprises a first housing having a first chamber formed therein; a second housing having a second chamber formed therein; a first connector adapted to provide fluid communication between a duct and the first chamber; a second connector adapted to provide fluid communication between the duct and the first chamber, the second connector having a neck diameter and a cover portion movable between an open position, a plurality of intermediate positions, and a closed position to change an inlet area of the neck diameter to facilitate attenuation of a desired frequency of a first sound wave entering the resonator; a third connector adapted to provide fluid communication between the duct and the second chamber; a fourth connector adapted to provide fluid communication between the duct and the second chamber, the fourth connector having a neck diameter and a cover portion movable between an open position, a plurality of intermediate positions, and a closed position to change an inlet area of the neck diameter to facilitate attenuation of a desired frequency of a second sound wave entering the resonator; and a resonator control system comprising: an engine speed sensor and a programmable control module in communication with the engine speed sensor, wherein the programmable control module controls the movement of the cover portion of at least one of the second connector and the fourth connector responsive to a signal from the engine speed sensor.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which:

FIG. 1 is a schematic diagram of a continuously variable tuned resonator in accordance with an embodiment of the invention;

FIGS. 2A-2D are a front views of a rotating partition valve shown in FIG. 1 and illustrate multiple positions of the valve for facilitating various flow through rates to attenuate sound waves at variable frequencies;

DETAILED DESCRIPTION OF THE PREFERRED EMBODIMENT

Figure 3:
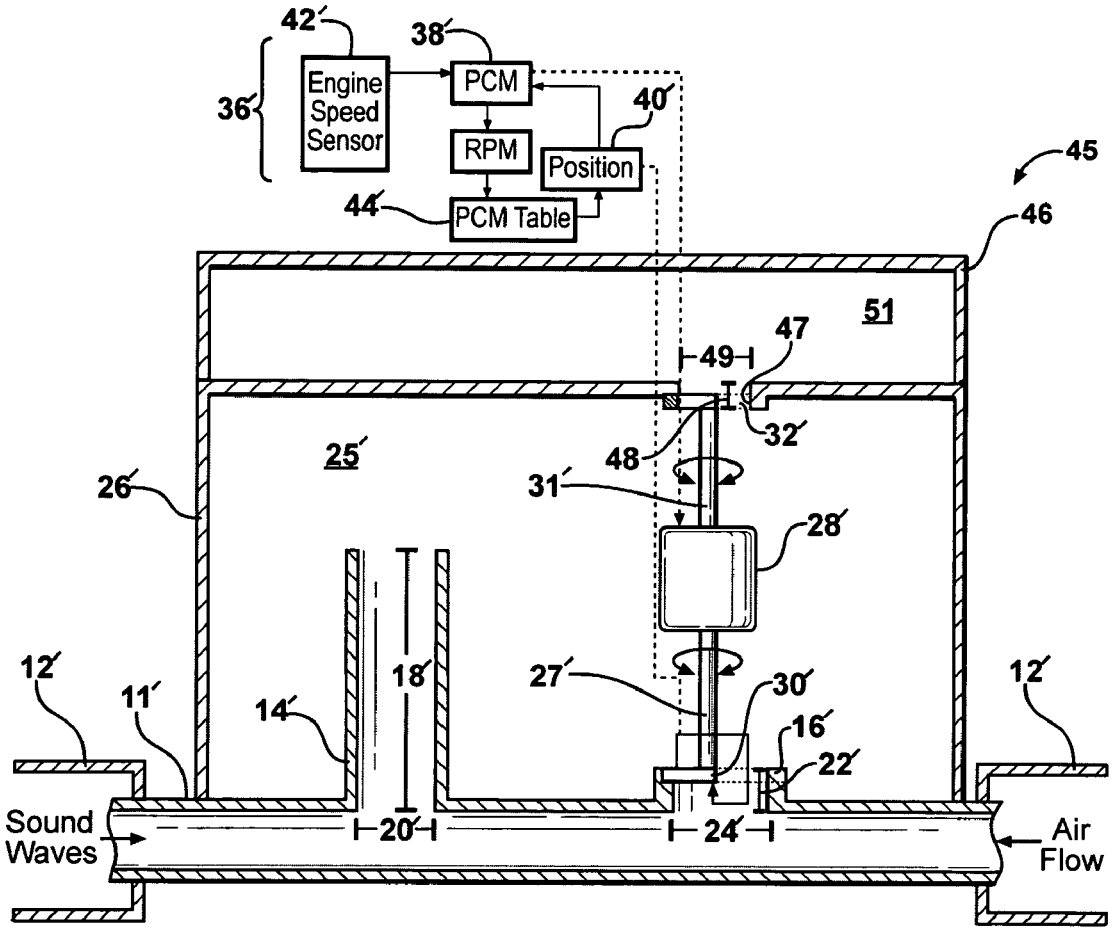
FIG. 3 is a schematic diagram of a continuously variable tuned resonator in accordance with another embodiment of the invention.

The following detailed description and appended drawings describe and illustrate various exemplary embodiments of the invention. The description and drawings serve to enable one skilled in the art to make and use the invention, and are not intended to limit the scope of the invention in any manner.

FIG. 1 shows a continuously variable tuned resonator 10 for use in a vehicle air intake system (not shown) according to an embodiment of the invention. The resonator 10 includes a resonator duct 11 that is attached to a first duct 12 which is in communication with an engine (not shown) and an air cleaner (not shown). The resonator duct 11 can be attached to the first duct 12 by any conventional means, such as clamping, for example. It is understood that the resonator 10 can be disposed in other locations without departing from the scope and spirit of the invention, such as between an air intake (not shown) and the air cleaner, for example. Preferably, the resonator duct 11 is formed from plastic and the first duct 12 is formed from rubber.

A first connector 14 and a second connector 16 are disposed on the resonator duct 11. Optionally, a sealing member (not shown), such as a valve, for example, can be disposed in the resonator duct 11 adjacent the first connector 14. The first connector 14 has a neck length 18 and a neck diameter 20. The second connector 16 has a neck length 22 and a neck diameter 24. A chamber 25 in fluid communication with the first connector 14 and the second connector 16 is formed in a housing 26 that is disposed on the resonator duct 11. Preferably, the first connector 14, the second connector 16, and the housing 26 are formed from plastic.

A first shaft 27 operatively couples a motor 28 to a first valve 30 within the chamber 25. It is understood that the first shaft 27, the motor 28, and the first valve 30 can be disposed outside of the chamber 25 if desired. While the valve first 30 is a rotating partition valve, any valve or movable cover portion can be used as desired, such as a butterfly valve, a rotating door valve, or a sliding door valve, for example. As more clearly shown in FIGS. 2A-2D, the first valve 30 includes a main body 35, a cover portion 37, a pivot point 39, and an aperture 41.

A second shaft 31 operatively couples the motor 28 to a second valve 32 that engages the housing 26 around an aperture 33 formed in the housing 26. It is understood that the structure of the second valve 32 is substantially the same as of the first valve 30. A flexible membrane 34 is sealingly connected to the housing around the aperture 33.

The motor 28 is in electrical communication with a control system 36 that includes a programmable control module (PCM) 38, a position sensor and transmitter 40, and an engine speed sensor and transmitter 42. The position sensor and transmitter 40 is in electrical communication with the first valve 30 and the PCM 38. The engine speed sensor and transmitter 42 is in electrical communication with the engine and the PCM 38.

To better understand the physics of the acoustic behavior of the resonator 10, a mechanical analogy of a spring mass system will be used to describe its' function. The air in the chamber 25 is equivalent to the spring, and the air in the connectors 14, 16 is equivalent to the system mass. The forces acting on the connector mass are the wave pressure in the resonator duct 11 acting over the area of the connectors 14, 16 F=P*A, the inertial force of the mass and the counteracting force of the compressed air in the chamber 25.

In operation, the sealing member is selectively moved into an open position or a closed position. While in a closed position, the flow of fluid through the first connector 14 into the chamber 25 is militated against. It is understood that if the sealing member is in a closed position and the first valve 30 is in a closed position, the functionality of the resonator 10 is minimized. While in an open position, the sound waves generated by the engine air induction process and other sources impose a force on masses of air located in the first connector 14 and the second connector 16, wherein the force is proportional to the respective areas of the connectors 14, 16.

As a result, these masses are accelerated into the chamber 25 and compress air in the chamber 25. When the sum of the inertial force of the masses and the force acting on the masses by the sound wave equal the compressive force, the masses reverse direction and travel back out of the first connector 14 and the second connector 16. Accordingly, the timing of the return wave is controlled by the selection of the chamber 25 volume and the connector 14, 16 geometries. When the timing of the sound wave caused by the movement of masses results in a 180 degree wave shift relative to a frequency component of the next subsequent wave, cancellation of the two sound waves will occur.

Thereafter, additional sound waves generated by the engine and other sources are caused to be combined with the sound waves traveling out of the resonator 10. The combination of the sound waves generated by the engine and other sources with the out of phase sound waves results in a reduction or cancellation of the amplitude of the sound waves, and an attenuation of the sound waves is accomplished.

The frequency of the sound waves generated by the engine differs at different engine speeds. Therefore, in order to meet target noise levels, the resonator 10 is required to attenuate sound waves having a wide range of sound wave frequencies. This is accomplished by varying the position of the first valve 30 to cause an adjustment to the mass of air in connector 16 which travels into the chamber 25. The frequency of the sound wave that is attenuated by the resonator 10 is predicted according to the following equation, wherein f is the frequency of the sound wave, c is the speed of sound, $L_{eff}$ is the length of the connector plus 0.85 times the diameter of the connector, A is the area of the connector, and V is the volume of the chamber:

$$f = \frac{c}{2\pi}\sqrt{\frac{L_{1,eff}A2 + L_{2,eff}A_1}{V(L_{1,eff}L_{2,EFF})}}$$

To adjust the area of second connector 16, the cover portion 37 of the valve 30 is rotated about the pivot point 39 to expose different portions of the aperture 41 to facilitate various connector 16 masses which enter through the first valve 30.

Accordingly, the first valve 30 can be selectively opened, closed or moved to intermediate positions to facilitate attenuation of sound at any number of different frequencies. When the first valve 30 is in a fully closed position as shown in FIG. 2A, the mass of air in connector 14 travels further into chamber 25 by virtue of its larger inertia and smaller area relative to connector 16, and the time required for the air to compress and force the sound waves back out of the resonator 10 is maximized. Thus, while the valve 30 is in a closed position, the resonator 10 attenuates sound at low frequencies. As the first valve 30 becomes more open from FIG. 2B-2D, the travel time of the connector mass into the chamber 25 decreases since the counteracting compression force increases faster than the forces pushing the mass into the chamber. Accordingly, the time to return the mass acting on the sound wave is reduced and the resonator attenuates noise at higher frequencies. When the first valve 30 is in a fully open position as shown in FIG. 2D, the time required for the air to compress and force the sound waves out of the resonator 10 is minimized, and the resonator 10 attenuates sound waves at the highest possible frequency facilitated by the resonator 10. Thus, a desired attenuation of sound waves emitted from the vehicle engine over a wide range of frequencies is accomplished.

The motor 28 is used to change the position of the first valve 30 to control an inlet area into the chamber 25 through the second connector 16. By controlling the inlet area into the chamber 25 through the second connector 16, the mass of air in the connector 16 permitted to travel into the chamber 25 is controlled as discussed above. When the motor 28 adjusts the position of the first valve 30, the position of the second valve 32 is simultaneously adjusted. The second valve 32 is adjusted to control an outlet area of the housing 26 through the aperture 33 formed therein. The flexible membrane 34 militates against the flow of fluid therethrough, but permits sound waves to pass therethrough. Therefore, fluid containing unwanted particles is not allowed to enter the chamber 25 of the resonator 10 through the aperture 33; however, sound waves are permitted to travel out of the aperture 33 and escape into the atmosphere. This feature may be used in different ways. For example, a small aperture 33 reduces the attenuation in the engine induction system in situations where a large attenuation is undesirable. In a second way, a large aperture 33 transmits high amplitude sound, which may be desirable in situations where the generation of sound waves having desired frequencies is produced by the resonator 10, such as for engines that produce very little sound, for example. It is understood that the second shaft 31, the second valve 32, the aperture 33, and the flexible membrane 34 are not necessary for the normal sound wave attenuation of the resonator 10 and can be excluded if desired.

The position sensor and transmitter 40 provides positional feedback for the first valve 30 to the PCM 38. The engine speed sensor and transmitter 42 senses and transmits engine speed to the PCM 38. The PCM 38 accesses a PCM table 44 to find a required position for the first valve 30 based upon the engine speed. The required position of the first valve 30 is then compared with the positional feedback from the position sensor and transmitter 40. If the positional feedback differs from the required position, a position adjustment is made by the PCM 38 by causing the motor 28 to adjust the position of the first valve 30 as needed.

Controlling the resonator 10 by the PCM 38 is accomplished by first mapping the characteristics of the resonator 10 at various first valve 30 positions at each engine speed. The first valve 30 positions versus engine speed are organized into the PCM table 44. The first valve 30 positions are determined by comparing the difference between base and target characteristics at each engine speed to a map of resonator performance. The first valve 30 position which best meets the target at each engine speed is organized into the PCM table 44. It should be noted that to achieve the best efficiency, the resonator 10 should be placed in the air induction system of the vehicle where it will most efficiently attenuate the frequencies of interest. For example, the chosen location should not be near a pressure nodal point of the frequencies of interest, but at a location where the standing wave pressures for the frequencies of interest are values which would provide reasonable attenuation.

In situations where sound wave amplification is desired, the resonator 10 may be disposed in alternate positions in the vehicle air intake system. For example, the resonator 10 may be connected to a secondary duct (not shown) that is a branch of the first duct 12. Favorable results have been found wherein the secondary duct is branched off from the first duct 12 between an intercooler (not shown) and a throttle body (not shown). It is understood that the resonator 10 can be disposed in other positions as desired.

The PCM table 44 is modified to determine positions of the first valve 30 that amplify sound waves to meet desired noise targets. The first valve 30 position which best meets the target at each engine speed is organized into the PCM table 44. The position sensor and transmitter 40 provides positional feedback of the first valve 30 to the PCM 38. The engine speed sensor and transmitter 42 senses and transmits engine speed to the PCM 38. The PCM 38 accesses the modified PCM table 44 to find a required position for the valve 30 based upon engine speed. The required position of the first valve 30 is then compared with the positional feedback from the position sensor and transmitter 40. If the positional feedback differs from the required position, a position adjustment is made by the PCM 38 by operating the motor 28 to adjust the first valve 30 as needed.

FIG. 3 shows a continuously variable tuned resonator 45 for use in a vehicle air intake system (not shown) according to another embodiment of the invention. Similar structure to that described above for FIG. 1 repeated herein with respect to FIG. 3 includes the same reference numeral and a prime (') symbol. The resonator 45 includes a resonator duct 11' that is attached to a first duct 12' which is in communication with an engine (not shown) and an air cleaner (not shown). The resonator duct 11' can be attached to the first duct 12' by any conventional means, such as clamping, for example. It is understood that the resonator 45 can be disposed in other locations without departing from the scope and spirit of the invention, such as between an air intake (not shown) and the air cleaner, for example. Preferably, the resonator duct 11' is formed from plastic and the first duct 12' is formed from rubber.

A first connector 14' and a second connector 16' are disposed on the resonator duct 11'. The first connector 14' has a neck length 18' and a neck diameter 20'. The second connector 16' has a neck length 22' and a neck diameter 24'. A chamber 25' in fluid communication with the first connector 14' and the second connector 16' is formed in a housing 26' that is disposed on the resonator duct 11'. Preferably, the first connector 14', the second connector 16', and the housing 26' are formed from plastic.

A first shaft 27' operatively couples a motor 28' to a first valve 30' within the chamber 25'. Structure of the first valve 30' and a second valve 32' is substantially the same as structure of the first valve 30 discussed above for FIGS. 1 and 2. It is understood that the first shaft 27', the motor 28', and the first valve 30' can be disposed outside of the chamber 25' if desired. While the first valve 30' and the second valve 32' shown are rotating partition valves, any valve or movable cover portion can be used as desired, such as a butterfly valve, a rotating door valve, or a sliding door valve, for example. A second shaft 31' operatively couples the motor 28' to the second valve 32'. A second housing 46 having a second chamber 51 is mounted to the housing 26'. A third connector 47 in fluid communication with the chamber 25' and the second chamber 51 is disposed between the chamber 25' and the second chamber 51. Preferably, the third connector 47 and the second housing 46 are formed from plastic. The third connector 47 has a neck length 48 and a neck diameter 49. In this embodiment, a single motor 28' is operatively coupled to the first valve 30' and the second valve 32', and movement of the first valve 30' is dependant upon movement of the second valve 32'. It is understood that if independent movement of the valves 30', 32' is desired, a second motor (not shown) can be used to operate the other of the valves 30', 32'. Independent movement of the valves 30', 32' could also be accomplished with the use of a clutch or similar structure (not shown) connected to one of the valves 30', 32'

The motor 28' is in electrical communication with a control system 36' that includes a programmable control module (PCM) 38', a position sensor and transmitter 40', and an engine speed sensor and transmitter 42'. The position sensor and transmitter 40' is in electrical communication with the first valve 30' and the PCM 38'. It is understood that the position sensor and transmitter 40' can be in electrical combination with the second valve 32' instead of or in combination with the first valve 30' as desired. The engine speed sensor and transmitter 42' is in electrical communication with the engine and the PCM 38'.

In operation, sound waves generated by the engine and other sources travel through the first duct 12' and into the resonator duct 11' in the direction indicated in FIG. 3. The sound waves push masses of air located in the first connector 14' and the second connector 16' into chamber 25', and the resulting compression wave inside chamber 25' pushes a mass of air located in the third connector 47 into the second chamber 51. As the masses of air located in the first connector 14', the second connector 16', and the third connector 47 travel into the chamber 25' and the second chamber 51, air in the chambers 25', 51 is caused to compress. Upon reaching a predetermined compression within the chamber 25', the compressed air forces the masses of air back out of the first connector 14' and the second connector 16'. Similarly, upon reaching a predetermined compression within the second chamber 51, the compressed air forces the mass of air back out of the third connector 47. As a result, two separate frequency components of sound waves are 180 degrees out of phase from when they traveled into the chambers 25', 51. Thereafter, additional sound waves that are generated by the engine induction process and other sources are caused to be combined with the sound waves traveling out of the resonator 45. The combination of the sound waves generated by the engine induction process and other sources with the out of phase sound waves results in a reduction or cancellation of the amplitudes of the two separate sound waves, and an attenuation of the two separate sound waves is accomplished.

The frequencies of the sound waves generated by the engine differ at different engine speeds. Therefore, in order to meet target noise levels, the resonator 45 is required to attenuate sound waves having a wide range of frequencies. This is accomplished by varying the position of the first valve 30' and the second valve 32' to cause an adjustment to the masses of air located in the connectors 16', 47 that are permitted to travel into the chamber 25' through the second connector 16', and to enter into the second chamber 51 through the third connector 47. The valves 30', 32' can be selectively opened, closed or moved to intermediate positions to facilitate attenuation of two separate sound waves having different frequencies at any number of different frequencies. As discussed above for FIGS. 1 and 2, when the valves 30', 32' are in fully closed positions, the resonator 45 attenuates one frequency of the sound waves at low frequencies. As the valves 30', 32' become more open, the resonator 45 attenuates two separate frequencies of sound waves at higher frequencies since the sound wave reflected in each chamber 25, 51 are out of phase with the subsequent sound waves produced by the engine induction and other sources. Thus, an attenuation of two separate frequencies of sound waves emitted from the engine and other sources over a wide range of frequencies is accomplished.

The motor 28' is used to change the position of the valves 30', 32' to control inlet areas into the chambers 25', 51 through the second connector 16' and the third connector 47. By controlling the inlet area into the chamber 25' through the second connector 16' and the second chamber 51 through the third connector 47, the mass of air permitted to travel into the chambers 25', 51 is controlled as discussed above. When the motor 28' adjusts the position of the first valve 30', the position of the second valve 32' is simultaneously adjusted. It is understood that positions of the valves 30', 32' are not necessarily the same. While movement of the vales 30', 32' is dependant, when one of the valves 30', 32' is in a fully open position, the other of the valves 30', 32' may be in a fully open, a fully closed, or an intermediate position. Further, a movement of one of the valves 30', 32' to adjust the inlet area of the respective connector 16', 47 does not necessarily facilitate a similar adjustment of the inlet area of the other connector 16', 47. For example, a quarter turn one of the valves 30', 32' may facilitate an exposure of substantially half of the inlet area of the respective connector 16', 47, where an exposure of the other connector 16', 47 by the same quarter turn may facilitate an exposure of more or less than half of the inlet area.

The position sensor and transmitter 40' provides positional feedback of the first valve 30' to the PCM 38'. The engine speed sensor and transmitter 42' senses and transmits engine speed to the PCM 38'. The PCM 38' accesses a PCM table 44' to find a required position for the first valve 30' based upon engine speed. The required position of the first valve 30' is then compared with the positional feedback from the position sensor and transmitter 40'. If the positional feedback differs from the required position, a position adjustment is made by the PCM 38' by causing the motor 28' to adjust the first valve 30' as needed. Accordingly, adjustment to the position of the second valve 32' is also made.

Controlling the resonator 45 by the PCM 38' is accomplished in the same manner as described above for FIG. 1, wherein the valve 30', 32' positions versus engine speed for each of the first valve 30' and the second valve 32' are organized into the PCM table 44'.

Figure 4:
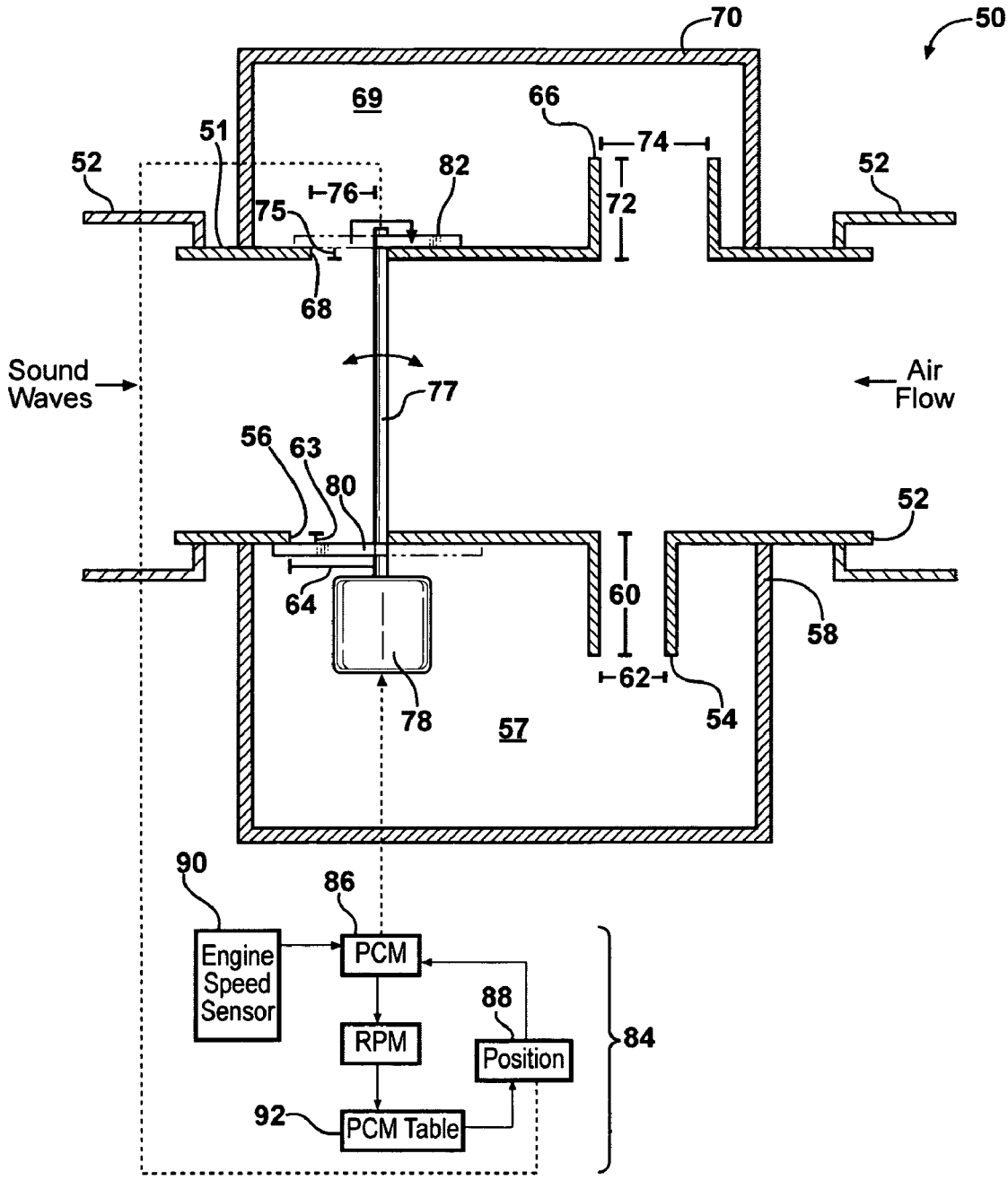
FIG. 4 is a schematic diagram of a continuously variable tuned resonator in accordance with another embodiment of the invention.

FIG. 4 shows a continuously variable tuned resonator 50 for use in a vehicle air intake system (not shown) in accordance with another embodiment of the invention. The resonator 50 includes a resonator duct 51 that is attached to a first duct 52 which is in communication with an engine (not shown) and an air cleaner (not shown). The resonator duct 51 can be attached to the first duct 52 by any conventional means, such as clamping, for example. It is understood that the resonator 50 can be disposed in other locations without departing from the scope and spirit of the invention, such as between an air intake (not shown) and the air cleaner, for example. Preferably, the resonator duct 51 is formed from plastic and the first duct 52 is formed from rubber.

A first connector 54 and a second connector 56 are disposed on the resonator duct 51. The first connector 54 has a neck length 60 and a neck diameter 62. The second connector 56 has a neck length 63 and a neck diameter 64. A first chamber 57 in fluid communication with the first connector 54 and the second connector 56 is formed in a first housing 58 that is disposed on the resonator duct 51. Preferably, the first connector 54, the second connector 56, and the first housing 58 are formed from plastic. A third connector 66 and a fourth connector 68 are disposed on the resonator duct 51. The third connector 66 has a neck length 72 and a neck diameter 74. The fourth connector 68 has a neck length 75 and a neck diameter 76. A second chamber 69 in fluid communication with the third connector 66 and the fourth connector 68 is formed in a second housing 70 that is disposed on the resonator duct 51. Preferably, the third connector 66, the fourth connector 68, and the second housing 70 are formed from plastic. The first connector 54, the second connector 56, and the first housing 58 are shown in FIG. 4 as being disposed on an opposed side of the resonator duct 51 from the third connector 66, the fourth connector 68, and the second housing 70. However, other configurations can be used without departing from the scope and spirit of the invention, such as wherein all four connectors 54, 56, 66, 68 and both of the housings 58, 70 are disposed on the same side of the resonator duct 51, for example.

A shaft 77 operatively couples a motor 78 to a first valve 80 and a second valve 82. Structure of the valves 80, 82 is substantially the same as structure of the first valve 30 discussed above for FIGS. 1 and 2. The valves 80, 82 shown are rotating partition valves. However, other types of valves or movable cover portions can be used without departing from the scope and spirit of the invention. In this embodiment, a single motor 78 is operatively coupled to the first valve 80 and the second valve 82, and movement of the first valve 80 is dependant upon movement of the second valve 82. It is understood that if independent movement of the valves 80, 82 is desired, a second motor (not shown) can be used to operate the other of the valves 80, 82. Independent movement of the valves 80, 82 could also be accomplished with the use of a clutch or similar structure (not shown) connected to one of the valves 80, 82.

The motor 78 is in electrical communication with a control system 84 that includes a programmable control module (PCM) 86, a position sensor and transmitter 88, and an engine speed sensor and transmitter 90. The position sensor and transmitter 88 is in electrical communication with the second valve 82 and the PCM 86. The engine speed sensor and transmitter 90 is in electrical communication with the engine and the PCM 86. It is understood that the valve position sensor and transmitter 88 may be in communication with the first valve 80 instead of or in combination with the second valve 82 as desired.

In operation, sound waves generated by the engine and other sources travel through the first duct 52 and into the resonator duct 51 in the direction indicated in FIG. 4. The sound waves push masses of air located in the first connector 54 and the second connector 56 into the first chamber 57, and masses of air located in the third connector 66 and the fourth connector 68 into the second chamber 69. As the masses of air located in the connectors 54, 56, 66, 68 travel into the first chamber 57 and the second chamber 69, air in the chambers 57, 69 is caused to compress. Upon reaching a predetermined compression within the first chamber 57, the compressed air forces the masses of air back out of the first connector 54 and the second connector 56. Similarly, upon reaching a predetermined compression within the second chamber 69, the compressed air forces the masses of air back out of the third connector 66 and the fourth connector 68. As a result, two separate frequency components of the sound wave are 180 degrees out of phase from when they traveled into the chambers 57, 69. Thereafter, additional sound waves that are generated by the engine and other sources are caused to be combined with the sound waves traveling out of the resonator 50. The combination of the sound waves generated by the engine and other sources with the out of phase sound waves results in a reduction or cancellation of the amplitudes of the two separate sound waves, and an attenuation of the two separate sound waves is accomplished.

The frequencies of the sound waves generated by the engine differ at different engine speeds. Therefore, in order to meet target noise levels, the resonator 50 is required to attenuate sounds waves having a wide range of frequencies. This is accomplished by varying the positions of the first valve 80 and the second valve 82 to cause an adjustment of the masses of air located in the connectors 54, 56, 66, 68 permitted to enter into the first chamber 57 through the first connector 54 and the second connector 56, and to enter into the second chamber 69 through the third connector 66 and the fourth connector 68. The valves 80, 82 can be selectively opened, closed or moved to intermediate positions to facilitate attenuation of two separate sound waves having different frequencies at any number of different frequencies. As discussed above for FIGS. 1 and 2, when the valves 80, 82 are in fully closed positions, the resonator 50 attenuates two separate frequencies of sound waves at low frequencies. As the valves 80, 82 become more open, the resonator 50 attenuates two separate frequencies of sound waves at higher frequencies. Thus, the desired attenuation of two separate frequencies of sound waves emitted from the engine and other sources over a wide range of frequencies is accomplished. The frequency of the sound wave that is attenuated by the resonator 50 is predicted according to the equation discussed above for FIG. 1.

The motor 78 is used to change the positions of the valves 80, 82 to control inlet areas into the chambers 57, 69 through the second connector 56 and the fourth connector 68. By controlling the inlet area into the first chamber 57 through the second connector 56 and the second chamber 69 through the fourth connector 68, the mass of air permitted to travel into the chambers 57, 69 is controlled as discussed above. When the motor 78 adjusts the position of the first valve 80, the position of the second valve 82 is simultaneously adjusted. As discussed above with respect to FIG. 3, the position of the first valve 80 is not necessarily the same as the position of the second valve 82.

The position sensor and transmitter 88 provides positional feedback of the second valve 82 to the PCM 86. The engine speed sensor and transmitter 90 senses and transmits engine speed to the PCM 86. The PCM 86 accesses a PCM table 92 to find a required position for the second valve 82 based upon engine speed. The required position of the second valve 82 is then compared with the positional feedback from the position sensor and transmitter 88. If the positional feedback differs from the required position, a position adjustment is made by the PCM 86 by operating the motor 78 to adjust the second valve 82 as needed. Accordingly, adjustment to the position of the first valve 80 is also made.

Controlling the resonator 50 by the PCM 86 based on engine speed is accomplished in the same manner as described above for FIG. 1, wherein the valve 80, 82 positions versus engine speed for each of the first valve 80 and the second valve 82 are organized into the PCM table 92.

Figure 5:
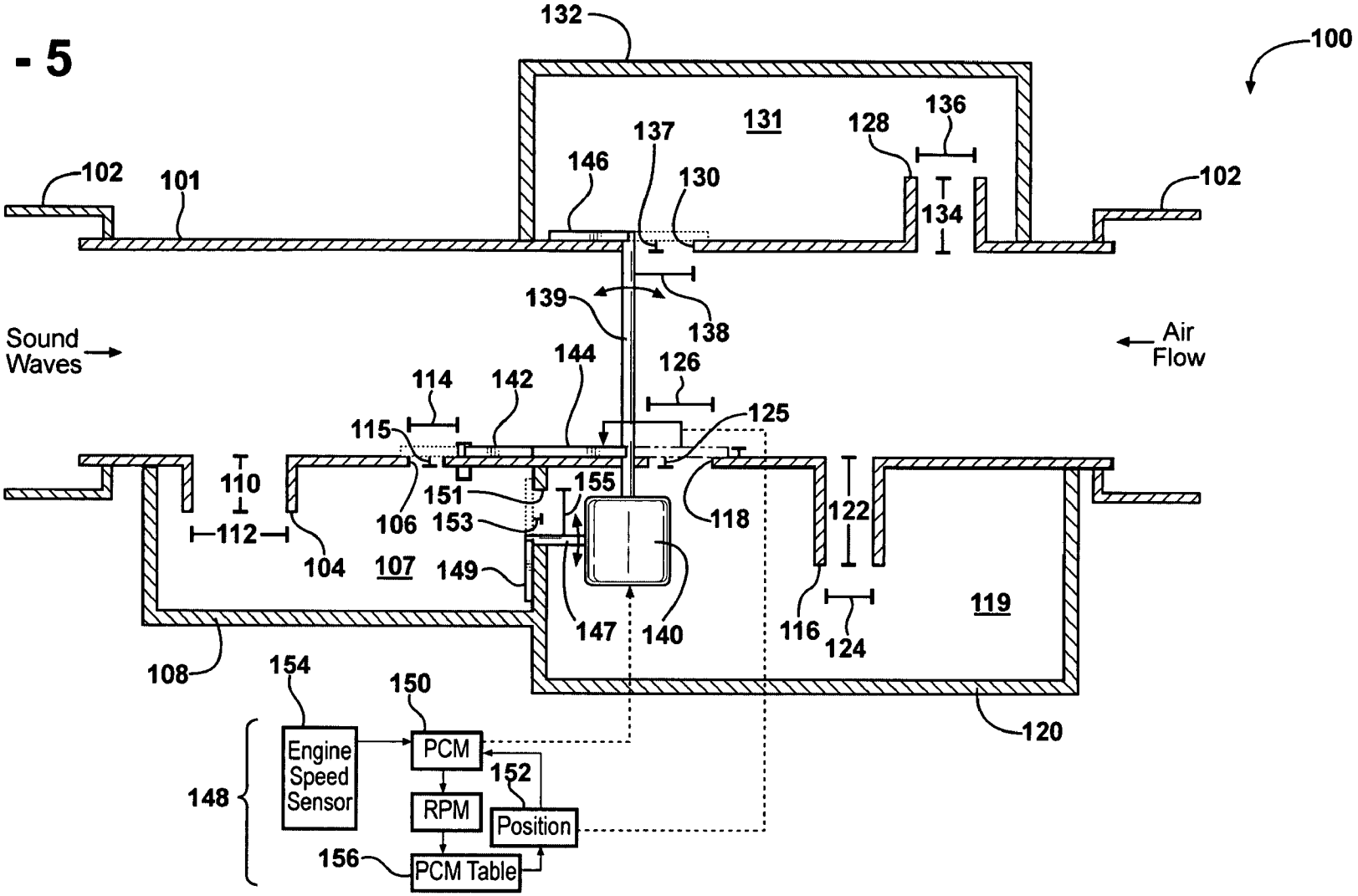
FIG. 5 is a schematic diagram of a continuously variable tuned resonator in accordance with another embodiment of the invention.

FIG. 5 shows a continuously variable tuned resonator 100 for use in a vehicle air intake system (not shown) in accordance with another embodiment of the invention. The resonator 100 includes a resonator duct 101 that is attached to a first duct 102 which is in communication with an engine (not shown) and an air cleaner (not shown). The resonator duct 101 can be attached to the first duct 102 by any conventional means, such as clamping, for example. It is understood that the resonator 100 can be disposed in other locations without departing from the scope and spirit of the invention, such as between an air intake (not shown) and the air cleaner, for example. Preferably, the resonator duct 101 is formed from plastic and the first duct 102 is formed from rubber.

A first connector 104 and a second connector 106 are disposed on the resonator duct 101. The first connector 104 has a neck length 110 and a neck diameter 112. The second connector 106 has and a neck length 113 and a neck diameter 114. A first chamber 107 in fluid communication with the first connector 104 and the second connector 106 is formed in a first housing 108 that is disposed on the resonator duct 101. Preferably, the first connector 104, the second connector 106, and the first housing 108 are formed from plastic. A third connector 116 and a fourth connector 118 are disposed on the resonator duct 101. The third connector 116 has a neck length 122 and a neck diameter 124. The fourth connector 118 has a neck length 125 and a neck diameter 126. A second chamber 119 in fluid communication with the third connector 116 and the fourth connector 118 is formed in a second housing 120 that is disposed on the resonator duct 101. Preferably, the third connector 116, the fourth connector 118, and the second housing 120 are formed from plastic. A fifth connector 128 and a sixth connector 130 are disposed on the resonator duct 101. The fifth connector 128 has a neck length 134 and a neck diameter 136. The sixth connector 130 has a neck length 137 and a neck diameter 138. A third chamber 131 in fluid communication with the fifth connector 128 and the sixth connector 130 is formed in a third housing 132 that is disposed on the resonator duct 101. Preferably, the fifth connector 128, the sixth connector 130, and the third housing 132 are formed from plastic. The first connector 104, the second connector 106, the third connector 116, the fourth connector 118, the first housing 108, and the second housing 120 are shown in FIG. 5 as being disposed on an opposed side of the resonator duct 101 from the fifth connector 128, the sixth connector 130, and the third housing 132. However, other configurations can be used without departing from the scope and spirit of the invention, such as wherein all six connectors 104, 106, 116, 118, 128, 130 and all three housings 108, 120, 132 are disposed on the same side of the resonator duct 101, for example.

A shaft 139 operatively couples a motor 140 to a second valve 144 and a third valve 146. A first valve 142 is operatively coupled to the second valve 144. Structure of the valves 142, 144, 146 is substantially the same as structure of the first valve 30 discussed above for FIGS. 1 and 2. The valves 142, 144, 146 shown are rotating partition valves. However, other types of valves or movable cover portions can be used without departing from the scope and spirit of the invention.

A second shaft 147 operatively couples the motor 140 to the fourth valve 149. Structure of the valve 149 is substantially the same as structure of the first valve 30 discussed above for FIGS. 1 and 2. The valve 149 shown is a rotating partition valve. However, other types of valves or movable cover portions can be used without departing from the scope and spirit of the invention. A seventh connector 151 in fluid communication with the first chamber 107 and the second chamber 119 is disposed between the first chamber 107 and the second chamber 119. Preferably, the seventh connector 151 is formed from plastic. The seventh connector 151 has a neck length 153 and a neck diameter 155.

In this embodiment, a single motor 140 is operatively coupled to the second valve 144, the third valve 146, and the fourth valve 149, and movement of the first valve 142, the third valve 146, and the fourth valve 149 is dependant upon movement of the second valve 144. It is understood that if independent movement of the valves 142, 144, 146, 149 is desired, a second motor (not shown), a third motor (not shown), and a fourth motor (not shown) can be used to operate the other of the valves 142, 144, 146, 149. Independent movement of the valves 142, 144, 146, 149 could also be accomplished with the use of a clutch or similar structure (not shown) connected to one or more of the valves 142, 144, 146, 149.

The motor 140 is in electrical communication with a control system 148 that includes a programmable control module (PCM) 150, a position sensor and transmitter 152, and an engine speed sensor and transmitter 154. The position sensor and transmitter 152 is in electrical communication with the second valve 144 and the PCM 150. The engine speed sensor and transmitter 154 is in electrical communication with the engine and the PCM 150. It is understood that the valve position sensor and transmitter 152 may be in communication with the first valve 142, the third valve 146, and/or the fourth valve 149 instead of or in combination with the second valve 144 as desired.

In operation, sound waves generated by the engine and other sources travel through the first duct 102 and into the resonator duct 101 in the direction indicated in FIG. 5. The sound waves push the masses of air located in the first connector 104 and the second connector 106 into the first chamber 107, masses of air located in the third connector 116 and the fourth connector 118 into the second chamber 119, and masses of air in the fifth connector 128 and the sixth connector 130 into the third chamber 131. As the sound waves push the masses of air into the first chamber 107, the second chamber 119, and the third chamber 131, air in the chambers 107, 119, 131 is caused to compress. Upon reaching a predetermined compression within the first chamber 107, the compressed air forces the masses of air back out of the first connector 104 and the second connector 106. Similarly, upon reaching a predetermined compression within the second chamber 119, the compressed air forces the masses of air back out of the third connector 116 and the fourth connector 118, and upon reaching a predetermined compression within the third chamber 131, the compressed air forces the masses of air back out of the fifth connector 128 and the sixth connector 130. As a result, three separate sound waves are 180 degrees out of phase from when they traveled into the chambers 107, 119, 131. Thereafter, additional sound waves that are generated by the engine and other sources are caused to be combined with the sound waves traveling out of the resonator 100. The combination of the sound waves generated by the engine and other sources with the out of phase sound waves results in a reduction or cancellation of the amplitudes of the three separate sound waves, and an attenuation of the three separate sound waves is accomplished.

The frequencies of the sound waves generated by the engine differ at different engine speeds. Therefore, in order to meet target noise levels, the resonator 100 is required to attenuate sound waves having a wide range of frequencies. This is accomplished by varying the positions of the first valve 142, the second valve 144, and the third valve 146 to cause an adjustment of the masses of air permitted to flow into the first chamber 107, the second chamber 119, and the third chamber 131. The fourth valve 149 is varied to cause an adjustment of the mass of air permitted to flow between the first chamber 107 and the second chamber 119. The valves 142, 144, 146, 149 can be selectively opened, closed or moved to intermediate positions to facilitate attenuation of three separate sound waves having different frequencies at any number of different frequencies. As discussed above for FIGS. 1 and 2, when the valves 142, 144, 146 are in fully closed positions, the resonator 100 attenuates three separate frequencies of sound waves at low frequencies. As the valves 142, 144, 146 become more open, the resonator 100 attenuates three separate frequencies of sound waves at higher frequencies. Thus, an attenuation of three separate frequencies of sound waves emitted from the engine and other sources over a wide range of frequencies is accomplished. The frequency of the sound wave that is attenuated by the resonator 100 is predicted according to the equation discussed above for FIG. 1. By adjusting the position of the fourth valve 149, the ratio between the frequencies that are attenuated by the resonator 100 is maximized.

The motor 140 is used to change the positions of the valves 142, 144, 146 to control inlet areas into the chambers 107, 119, 131 through the second connector 106, the fourth connector 118, and the sixth connector 130. By controlling the inlet area into the first chamber 107 through the second connector 106, the second chamber 119 through the fourth connector 118, and the third chamber 131 through the sixth connector 130, the volume of sound waves permitted to travel into the chambers 107, 119, 131 is controlled as discussed above. When the motor 140 adjusts the position of the second valve 144, the positions of the first valve 142 and third valve 146 are simultaneously adjusted. As discussed above with respect to FIG. 3, the position of the first valve 142 is not necessarily the same as the position of the second valve 144 or the third valve 146.

The position sensor and transmitter 152 provides positional feedback of the second valve 144 to the PCM 150. The engine speed sensor and transmitter 154 senses and transmits engine speed to the PCM 150. The PCM 150 accesses a PCM table 156 to find a required position for the second valve 144 based upon engine speed. The required position of the second valve 144 is then compared with the positional feedback from the position sensor and transmitter 152. If the positional feedback differs from the required position, a position adjustment is made by the PCM 150 by operating the motor 140 to adjust the second valve 144 as needed. Accordingly, adjustment to the positions of the first valve 142 and the third valve 146 are also made.

Controlling the resonator 100 by the PCM 156 based on engine speed is accomplished in the same manner as described above for FIG. 1, wherein the valve 142, 144, 146 positions versus engine speed for each of the first valve 142, the second valve 144, and the third valve 146 are organized into the PCM table 156.

Figure 6:
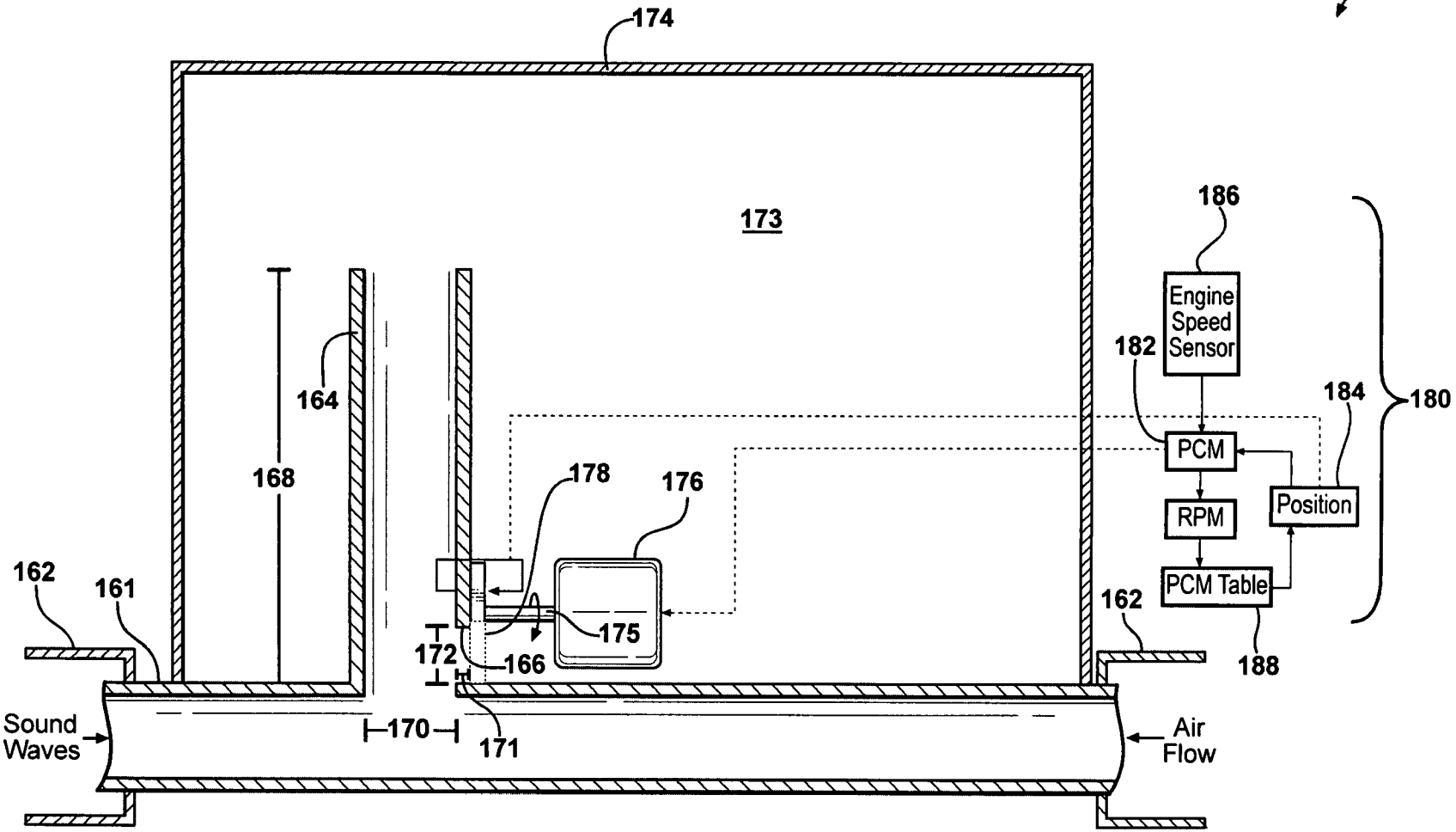
FIG. 6 is a schematic diagram of a continuously variable tuned resonator in accordance with another embodiment of the invention.

FIG. 6 shows a continuously variable tuned resonator 160 for use in a vehicle air intake system (not shown) according to another embodiment of the invention. The resonator 160 includes a resonator duct 161 that is attached to a first duct 162 which is in communication with an engine (not shown) and an air cleaner (not shown). The resonator duct 161 can be attached to the first duct 162 by any conventional means, such as clamping, for example. It is understood that the resonator 160 can be disposed in other locations without departing from the scope and spirit of the invention, such as between an air intake (not shown) and the air cleaner, for example. Preferably, the resonator duct 161 is formed from plastic and the first duct 162 is formed from rubber.

A first connector 164 is disposed on the resonator duct 161. A second connector 166 is disposed on the first connector 164. The first connector 164 has a neck length 168 and a neck diameter 170. The second connector 166 has a neck length 171 and a neck diameter 172. A chamber 173 in fluid communication with the first connector 164 and the second connector 166 is formed in a housing 174 that is disposed on the resonator duct 161. Preferably, the first connector 164, the second connector 166, and the housing 174 are formed from plastic.

A shaft 175 operatively couples a motor 176 to a valve 178 within the chamber 173. It is understood that the shaft 175, the motor 176, and the valve 178 can be disposed outside of the chamber 173 if desired. Structure of the valve 178 is substantially the same as structure of the first valve 30 discussed above for FIGS. 1 and 2. While the valve 178 shown is a rotating partition valve, any valve or movable cover portion can be used as desired, such as a butterfly valve, a rotating door valve, or a sliding door valve, for example. It is understood that additional connectors (not shown) can be used to provide fluid communication between the duct 162 and the chamber 173 as desired. It is also understood that additional housings (not shown) may be used with the additional connectors to attenuate additional sound waves having different frequencies as discussed above for FIGS. 3-5.

The motor 176 is in electrical communication with a control system 180 that includes a programmable control module (PCM) 182, a position sensor and transmitter 184, and an engine speed sensor and transmitter 186. The position sensor and transmitter 184 is in electrical communication with the valve 178 and the PCM 182. The engine speed sensor and transmitter 186 is in electrical communication with the engine and the PCM 182.

In operation, sound waves generated by the engine and other sources travel through the first duct 162 and into the resonator duct 161 in the direction indicated in FIG. 6. The sound waves push masses of air located the first connector 164 and the second connector 166 into the chamber 173. As the masses of air located in the connectors 164, 166 travel into the chamber 173, air in the chamber 173 is caused to compress. Upon reaching a predetermined compression, the compressed air forces the masses of air to travel back out of the first connector 164 and the second connector 166. As a result, one frequency component of the sound wave is 180 degrees out of phase from when they traveled into the chamber 173. Thereafter, additional sound waves that are generated by the engine and other sources are caused to be combined with the sound waves traveling out of the resonator 160. The combination of the sound waves generated by the engine and other sources with the out of phase sound waves results in a reduction or cancellation of the amplitude of the sound waves, and an attenuation of the sound waves is accomplished.

The frequency of the sound waves generated by the engine differs at different engine speeds. Therefore, in order to meet target noise levels, the resonator 160 is required to attenuate sound waves having a wide range of sound wave frequencies. This is accomplished by varying the position of the valve 178 to cause an adjustment to the masses of air located in the connectors 164, 166 that are permitted to travel into the chamber 173. The valve 178 can be selectively opened, closed or moved to intermediate positions to facilitate attenuation of sound waves at any number of different frequencies. As discussed above for FIGS. 1 and 2, when the valve 178 is in a fully closed position, the resonator 160 attenuates sound waves having low frequencies. As the valve 178 becomes more open, the resonator 160 attenuates sound waves having higher frequencies. When the valve is in a fully open position, the resonator 160 attenuates sound waves having the highest possible frequency facilitated by the resonator 160. Thus, an attenuation of sound waves emitted from the vehicle engine and other sources over a wide range of frequencies is accomplished. The frequency of the sound wave that is attenuated by the resonator 160 is predicted according to the equation discussed above for FIG. 1.

The motor 176 is used to change the position of the valve 178 to control an inlet area into the chamber 173 through the second connector 166. By controlling the inlet area into the chamber 173 through the second connector 166, the mass of air in the connectors 164, 166 permitted to travel into the chamber 173 is controlled as discussed above.

The position sensor and transmitter 184 provides positional feedback of the first valve 178 to the PCM 182. The engine speed sensor and transmitter 186 senses and transmits engine speed to the PCM 182. The PCM 182 accesses a PCM table 188 to find a required position for the first valve 178 based upon engine speed. The required position of the valve 178 is then compared with the positional feedback from the position sensor and transmitter 184. If the positional feedback differs from the required position, a position adjustment is made by the PCM 182 by operating the motor 176 to adjust the valve 178 as needed.

Controlling the resonator 160 by the PCM 182 is accomplished in the same manner as described above for FIG. 1, wherein the valve 178 positions versus engine speed for the first valve 178 are organized into the PCM table 188.

FIGS. 7A-7D show a sliding door valve 200 that may be used in the place of the rotating partition valve used in the above embodiments. The valve 200 includes a rotation means 202 that is operatively coupled to a motor (not shown). The rotation means 202 is in communication with a cover portion 204. The cover portion 204 slidingly engages a flow through portion 206. The flow through portion 206 is mounted to a connector 208 and includes a plurality of apertures 210 formed therein.

Figure 7A:
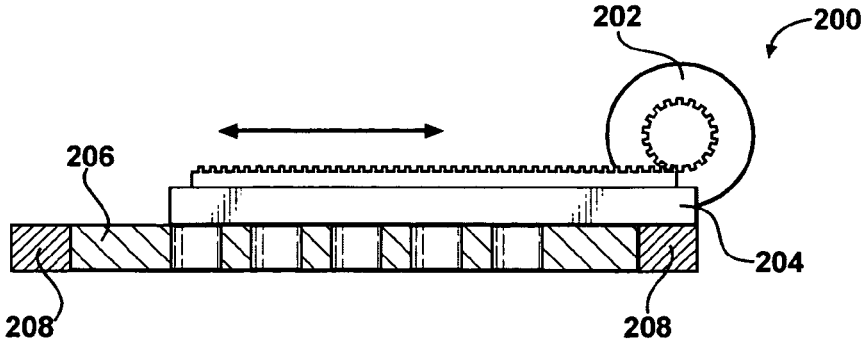
FIGS. 7A-7D are front views of a sliding door valve in accordance with another embodiment of the invention and illustrate multiple positions of the valve for facilitating various flow through rates to attenuate sound waves at variable frequencies.
Figure 7B:
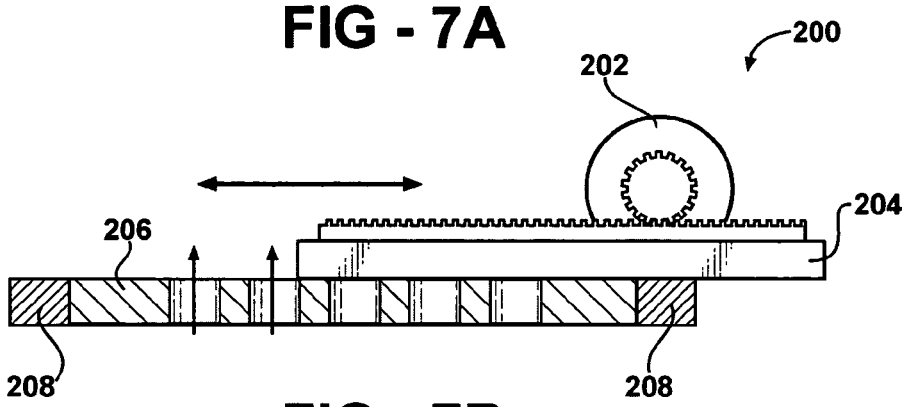
Figure 7C:
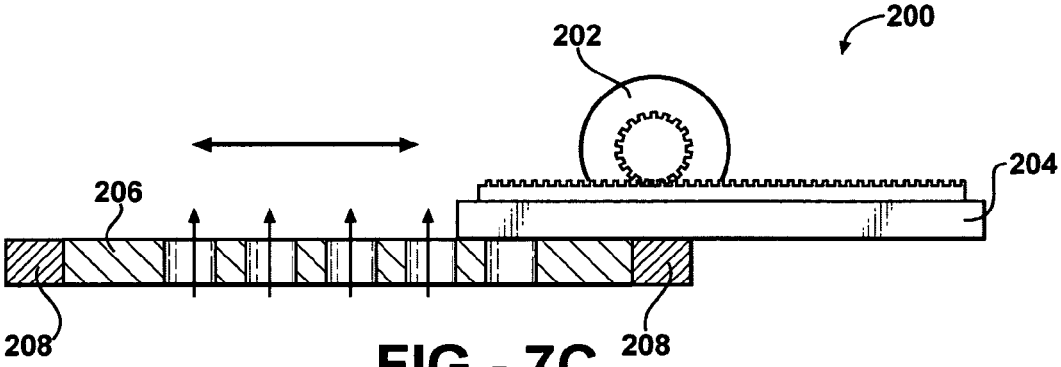
Figure 7D:
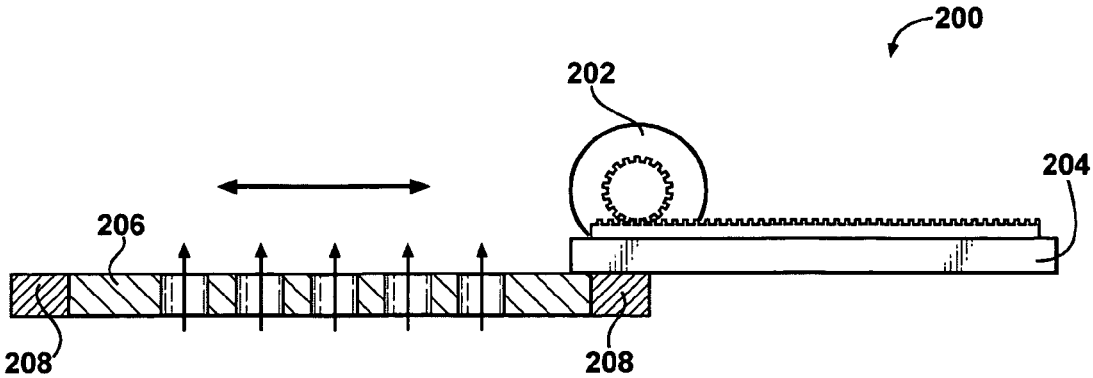

In operation, the rotation means 202 causes the cover portion 204 to slide to different positions relative to the flow through portion 206 to expose the apertures 210 formed in the flow through portion 206. It is understood that the apertures 210 can be sized to permit equal or different masses of the connector air therethrough. Accordingly, the valve 200 can be selectively opened, closed or moved to intermediate positions to facilitate any number of different masses of connector air therethrough. When the valve 200 is in a fully closed position as shown in FIG. 7A, the passage of air therethrough is militated against. As the valve 200 becomes more open from FIG. 7B-7D, larger masses of air are permitted to travel therethrough. When the valve 200 is in a fully open position as shown in FIG. 7D, the valve 200 permits the passage of a maximum mass of air therethrough. Thus, a desired mass of air is permitted to travel through the valve 200.

Figure 8:
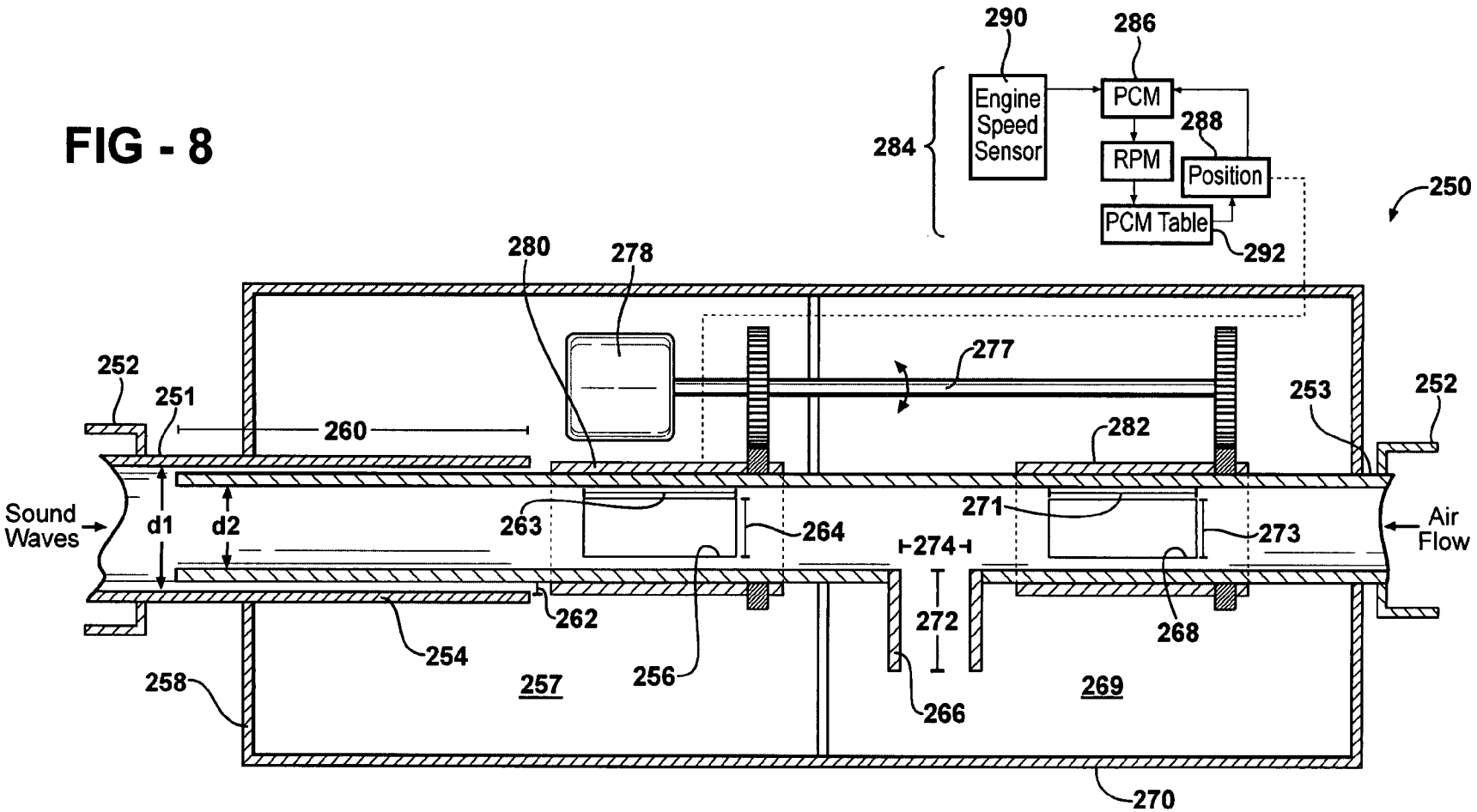
FIG. 8 is a schematic diagram of a continuously variable tuned resonator in accordance with another embodiment of the invention.
Figure 9A:
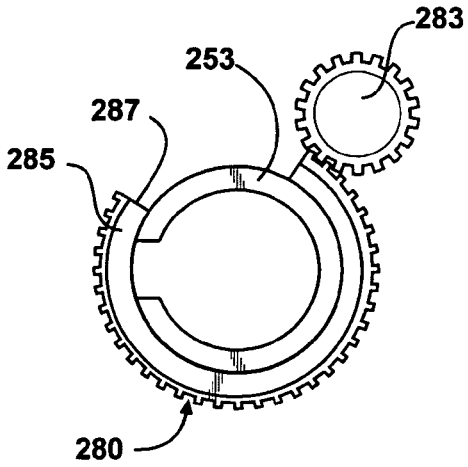
FIGS. 9A-9D are front views of a valve shown in FIG. 8 and illustrate multiple positions of the valve for facilitating various flow through rates to attenuate sound waves at variable frequencies.
Figure 9B:
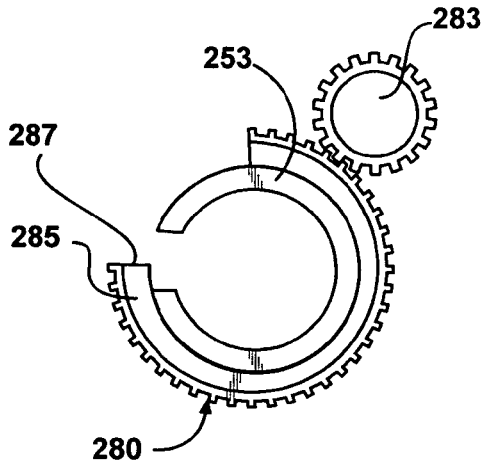
Figure 9C:
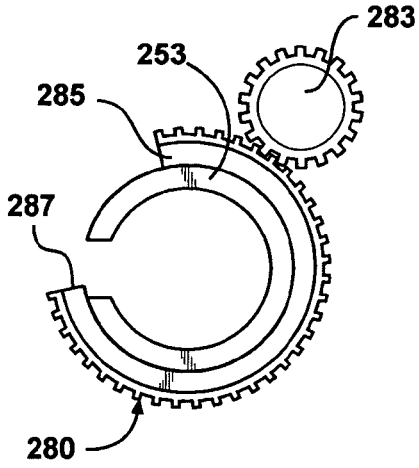
Figure 9D:
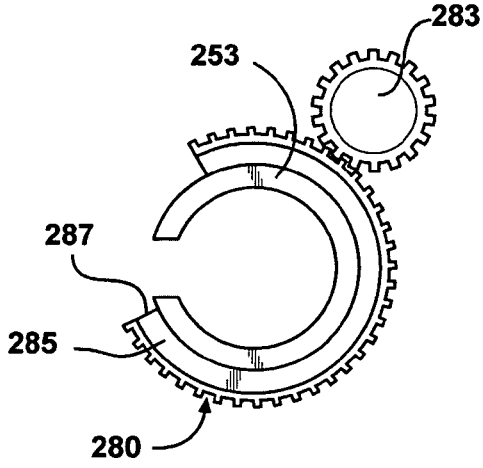

FIG. 8 shows a continuously variable tuned resonator 250 for use in a vehicle air intake system (not shown) in accordance with another embodiment of the invention. The resonator 250 includes a first resonator duct 251 and a second resonator duct 253 that are attached to a first duct 252 which is in communication with an engine (not shown) and an air cleaner (not shown). The resonator ducts 251, 253 can be attached to the first duct 12 by any conventional means, such as clamping, for example. It is understood that the resonator 250 can be disposed in other locations without departing from the scope and spirit of the invention, such as between an air intake (not shown) and the air cleaner, for example. Preferably, the resonator ducts 251, 253 are formed from plastic and the first duct 12 is formed from rubber.

The resonator ducts 251, 253 cooperate to form a first connector 254. A second connector 256 is disposed on the second resonator duct 253. The first connector 254 has a neck length 260 and a neck area 262 which is equal to the annulus area between the resonator ducts 251, 253. The neck area 262 of the first connector 254 is substantially equal to an area of a diameter d1 of the first resonator duct 251 minus an area of a diameter d2, plus two times a thickness of the second resonator duct 253. It should be appreciated that the second connector 256 is an aperture formed in the second resonator duct 253, wherein the neck area is the product of a length 263 (the horizontal length of the aperture in the drawing as shown), a neck width 264 (the vertical length of the aperture in the drawing as shown), and a neck height (the thickness of the second resonator duct 253. A first chamber 257 in fluid communication with the first connector 254 and the second connector 256 is formed in a first housing 258 that is disposed on the resonator ducts 251, 253. Preferably, the first connector 254, the second connector 256, and the first housing 258 are formed from plastic.

A third connector 266 and a fourth connector 268 are disposed on the second resonator duct 253. The third connector 266 has a neck length 272 and a neck diameter 274. It should be appreciated that the fourth connector 268 is an aperture formed in the second resonator duct 253, wherein the neck area is the product of a length 271 (the horizontal length of the aperture in the drawing as shown), a neck width 273 (the vertical length of the aperture in the drawing as shown), and a neck height (the thickness of the second resonator duct 253. A second chamber 269 is in fluid communication with the third connector 266 and the fourth connector 268 is formed in a second housing 270 that is disposed on the second resonator duct 253. Preferably, the third connector 266, the fourth connector 269, and the second housing 270 are formed from plastic.

A shaft 277 operatively couples a motor 278 to a first valve 280 and a second valve 282. As more clearly shown in FIGS. 9A-9D, the valves 280, 282 include a rotation means 283 and a tubular shaped cover portion 285. The rotation means 283 is operatively connected to the motor 278. The tubular shaped cover portion 285 includes an aperture 287 formed therein and is disposed around the duct 252. It is understood that other types of valves can be used without departing from the scope and spirit of the invention. In this embodiment, a single motor 278 is operatively coupled to the first valve 280 and the second valve 282, and movement of the first valve 280 is dependant upon movement of the second valve 282. It is understood that if independent movement of the valves 280, 282 is desired, a second motor (not shown) can be used to operate the other of the valves 280, 282. Independent movement of the valves 280, 282 could also be accomplished with the use of a clutch or similar structure (not shown) connected to one of the valves 280, 282.

The motor 278 is in electrical communication with a control system 284 that includes a programmable control module (PCM) 286, a position sensor and transmitter 288, and an engine speed sensor and transmitter 290. The position sensor and transmitter 288 is in electrical communication with the second valve 282 and the PCM 286. The engine speed sensor and transmitter 290 is in electrical communication with the engine and the PCM 286. It is understood that the valve position sensor and transmitter 288 may be in communication with the first valve 280 instead of or in combination with the second valve 282 as desired.

In operation, sound waves generated by the engine and other sources travel through the first duct 252 and into the resonator ducts 251, 253. The sound waves push masses of air located in the first connector 254 and the second connector 256 into the first chamber 257, and push the masses of air located in the third connector 266 and fourth connector 268 into the second chamber 269. As the masses of air located in the connectors 254, 256, 266, 268 travel into the first chamber 257 and the second chamber 269, air in the chambers 257, 269 is caused to compress. Upon reaching a predetermined compression within the first chamber 257, the compressed air forces the masses of air back out of the first connector 254 and the second connector 256. Similarly, upon reaching a predetermined compression within the second chamber 269, the compressed air forces the masses of air back out of the third connector 266 and the fourth connector 268. As a result, two separate frequency components of the sound wave are 180 degrees out of phase from when they traveled into the chambers 257, 269. Thereafter, additional sound waves that are generated by the engine and other sources are caused to be combined with the sound waves traveling out of the resonator 250. The combination of the sound waves generated by the engine and other sources with the out of phase sound waves results in a reduction or cancellation of the amplitudes of the two separate sound waves, and an attenuation of the two separate sound waves is accomplished.

The frequencies of the sound waves generated by the engine differ at different engine speeds. Therefore, in order to meet target noise levels, the resonator 250 is required to attenuate sounds waves having a wide range of frequencies. This is accomplished by varying the positions of the first valve 280 and the second valve 282 to cause an adjustment of the masses of air located in the connectors 254, 256, 266, 268 permitted to flow into the first chamber 257 and the second chamber 269. The valves 280, 282 can be selectively opened, closed or moved to intermediate positions to facilitate attenuation of two separate sound waves having different frequencies at any number of different frequencies. As discussed above for FIGS. 1 and 2, when the valves 280, 282 are in fully closed positions, the resonator 250 attenuates two separate sound waves having low frequencies. As the valves 280, 282 become more open, the resonator 250 attenuates two separate sound waves having higher frequencies. Thus, an attenuation of two separate frequencies of sound emitted from the vehicle engine and other sources over a wide range of frequencies is accomplished. The frequency of the sound wave that is attenuated by the resonator 250 is predicted according to the equation discussed above for FIG. 1.

The motor 278 is used to cause the rotation means 283 to move the cover portions 285 of the valves 280, 282 to control inlet areas into the chambers 257, 269 through the second connector 256 and the fourth connector 268. By controlling the inlet area into the first chamber 257 through the second connector 256 and the second chamber 629 through the fourth connector 268, the mass of air permitted to travel into the chambers 257, 269 is controlled as discussed above. When the motor 278 adjusts the position of the first valve 280, the position of the second valve 282 is simultaneously adjusted. As discussed above with respect to FIG. 3, the position of the first valve 280 is not necessarily the same as the position of the second valve 282.

The position sensor and transmitter 288 provides positional feedback of the second valve 282 to the PCM 286. The engine speed sensor and transmitter 290 senses and transmits engine speed to the PCM 286. The PCM 286 accesses a PCM table 292 to find a required position for the second valve 282 based upon engine speed. The required position of the second valve 282 is then compared with the positional feedback from the position sensor and transmitter 288. If the positional feedback differs from the required position, a position adjustment is made by the PCM 286 by operating the motor 278 to adjust the second valve 282 as needed. Accordingly, adjustment to the position of the first valve 280 is also made.

Controlling the resonator 250 by the PCM 286 based on engine speed is accomplished in the same manner as described above for FIG. 1, wherein the valve 280, 282 positions versus engine speed for each of the first valve 280 and the second valve 82 are organized into the PCM table 292.

While the resonators 10, 45, 50, 100, 160, 250 illustrated above are shown as being mounted to the first ducts 12, 12', 52, 102, 162, 252, it is understood that the resonators 10, 45, 50, 100, 160, 250 could be disposed in other positions, such as adjacent an intake manifold (not shown) for example, without departing from the scope and spirit of the invention.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable tuned resonator comprising:

a first connector adapted to provide fluid communication between a duct and a first chamber, the first connector having a neck diameter providing a fixed inlet area to the chamber; and a second connector adapted to provide direct fluid communication between the duct and the first chamber, the second connector having a neck diameter and an adjustable cover portion movable between an open position, a plurality of intermediate positions, and a closed position to change an inlet area of the neck diameter to facilitate attenuation of a desired frequency of sound wave entering the resonator.

2. The variable tuned resonator defined in claim 1, wherein the cover portion of the second connector is a valve.

3. The variable tuned resonator defined in claim 1, further comprising a programmable control module in communication with the cover portion, wherein the programmable control module controls the movement of the cover portion responsive to an engine speed.

4. The resonator according to claim 3, including an engine speed sensor to sense and transmit engine speed to the programmable control module, wherein the programmable control module controls the movement of the cover portion responsive to a signal from the engine speed sensor.

5. The variable tuned resonator defined in claim 3, further comprising a cover portion position sensor for sensing the position of the cover portion, wherein the cover portion position sensor is in electrical communication with the programmable control module.

6. The variable tuned resonator defined in claim 1, wherein a length of the first connector is larger than a length of the second connector.

7. The variable tuned resonator defined in claim 1, further comprising a third connector and a fourth connector, the third connector adapted to provide fluid communication between the duct and a second chamber the fourth connector adapted to provide fluid communication between the duct and the second chamber and having a neck diameter and a cover portion movable between an open position, a plurality of intermediate positions, and a closed position to change the inlet area of the neck diameter to facilitate attenuation of a desired frequency of a second sound entering the resonator.

8. The variable tuned resonator defined in claim 1, wherein the cover portion is one of a rotating partition valve, a sliding door valve, and a butterfly valve.

9. The variable tuned resonator defined in claim 1, wherein the chamber is formed in a housing that includes an aperture formed on an outer wall thereof.

10. The variable tuned resonator defined in claim 9, further comprising a flexible membrane covering the aperture to militate against a flow of fluid through the aperture.

11. The variable tuned resonator defined in claim 9, further comprising a second housing having a second chamber and a third connector formed therein, the second chamber in fluid communication with the first chamber.

12. The variable tuned resonator defined in claim 11, wherein the third connector has a neck diameter and an adjustable cover portion movable between an open position, a plurality of intermediate positions, and a closed position to change an inlet area of the neck diameter to facilitate attenuation of a desired frequency of sound wave entering the resonator.

13. A variable tuned resonator comprising:

a first housing forming a first chamber therein;

a first connector adapted to provide fluid communication between a duct and the first chamber, the first connector having a neck diameter providing a fixed inlet area to the chamber;

a second connector adapted to provide direct fluid communication between the duct and the first chamber, the second connector having a neck diameter and an adjustable cover portion movable between an open position, a plurality of intermediate positions, and a closed position to change an inlet area of the neck diameter to facilitate attenuation of a desired frequency of sound wave entering the resonator; and a resonator control system comprising: a programmable control module in communication with the cover portion, wherein the programmable control module controls the movement of the cover portion responsive to an engine speed.

14. The variable tuned resonator according to claim 13, including an engine speed sensor to sense and transmit engine speed to the programmable control module.

15. The variable tuned resonator defined in claim 13, further comprising a cover portion position sensor for sensing the position of the cover portion, wherein the cover portion position sensor is in electrical communication with the programmable control module.

16. The variable tuned resonator defined in claim 13, further comprising a third connector and a fourth connector, the third connector adapted to provide fluid communication between the duct and a second chamber, the fourth connector adapted to provide fluid communication between the duct and the second chamber and having a neck diameter and a cover portion movable between an open position, a plurality of intermediate positions, and a closed position to change the inlet area of the neck diameter to facilitate attenuation of a desired frequency of a second sound entering the resonator.

17. The variable tuned resonator defined in claim 16, further comprising a fifth connector and a sixth connector, the fifth connector adapted to provide fluid communication between the duct and a third chamber, the sixth connector adapted to provide fluid communication between the duct and the third chamber and having a neck diameter and a cover portion movable between an open position, a plurality of intermediate positions, and a closed position to change the inlet area of the neck diameter to facilitate attenuation of a desired frequency of a third sound wave entering the resonator.

18. The variable tuned resonator defined in claim 13, further comprising a second housing having a second chamber and a third connector formed therein, the second chamber in fluid communication with the first chamber, the third connector having a neck diameter and an adjustable cover portion movable between an open position, a plurality of intermediate positions, and a closed position to change an inlet area of the neck diameter to facilitate attenuation of a desired frequency of sound wave entering the resonator.

19. A variable tuned resonator comprising:

a housing defining a first chamber, wherein the housing includes an aperture formed on an outer wall thereof;

a first connector adapted to provide fluid communication between a duct and the first chamber, the first connector having a neck diameter providing a fixed inlet area to the chamber;

a second connector adapted to provide fluid communication between the duct and the first chamber, the second connector having a neck diameter and a first adjustable cover portion movable between an open position, a plurality of intermediate positions, and a closed position to change an inlet area of the neck diameter to facilitate attenuation of a desired frequency of sound wave entering the resonator; and a second adjustable cover portion movable between an open position, a plurality of intermediate positions, and a closed position to change an outlet area of the aperture of the housing.

20. The variable tuned resonator defined in claim 10, further comprising a motor for simultaneously controlling a position of the first cover portion and the second cover portion.

* * * * *